US005147201A

United States Patent [19]

Xiong

[11] Patent Number: 5,147,201

[45] Date of Patent: Sep. 15, 1992

[54] ULTRA-LOW POLLUTANT EMISSIONS RADIANT GAS BURNER WITH STABILIZED POROUS-PHASE COMBUSTION

[75] Inventor: Tian-Yu Xiong, Darien, Ill.

[73] Assignee: Institute of Gas Technology, Chicago, Ill.

[21] Appl. No.: 615,583

[22] Filed: Nov. 19, 1990

[51] Int. Cl.[5] ..... F23D 3/40

[52] U.S. Cl. ..... 431/326; 431/328; 431/329; 431/7; 126/92 AC

[58] Field of Search ..... 431/7, 8, 326, 328, 431/329; 126/91 R, 91 A, 92 AC, 92 C

[56] References Cited

U.S. PATENT DOCUMENTS

| | | | |
|---|---|---|---|
| 1,331,022 | 2/1920 | Mathy | 431/328 |
| 3,155,142 | 11/1964 | Stack | 431/328 |
| 3,188,366 | 1/1962 | Flynn . | |
| 3,322,179 | 5/1967 | Goodell . | |
| 3,445,175 | 5/1969 | Krieger | 431/328 |
| 3,833,338 | 9/1974 | Badrock . | |
| 4,354,823 | 10/1982 | Buehl et al. . | |
| 4,416,618 | 11/1983 | Smith . | |
| 4,529,123 | 7/1985 | Johnson . | |
| 4,529,374 | 7/1985 | Malik et al. . | |
| 4,597,734 | 7/1986 | McCausland et al. . | |
| 4,599,066 | 7/1986 | Granberg . | |
| 4,604,051 | 8/1986 | Davies et al. . | |
| 4,605,369 | 8/1986 | Buehl | 431/328 |
| 4,608,012 | 8/1986 | Cooper . | |
| 4,610,623 | 9/1986 | Lambrecht . | |
| 4,643,662 | 2/1987 | Fleming . | |
| 4,666,400 | 5/1987 | Vigneau . | |
| 4,673,349 | 6/1987 | Abe et al. . | |
| 4,673,350 | 6/1987 | Collier . | |
| 4,850,862 | 7/1989 | Bjerklie | 431/328 X |
| 4,878,837 | 11/1989 | Otto . | |
| 4,889,481 | 12/1989 | Morris et al. | 431/328 |

*Primary Examiner*—Larry Jones
*Attorney, Agent, or Firm*—Speckman & Pauley

[57] ABSTRACT

A radiant gas burner having a porous matrix bed with a cross-sectional area that diverges along a generally longitudinal axis in a direction from an upstream end to a downstream end of the porous matrix bed. The burner has a fuel/air inlet and a flow distributor positioned near a downstream end of the fuel/air inlet, for distributing the fuel/air mixture throughout the porous matrix bed. A radiant surface layer is positioned adjacent and downstream from the downstream end of the porous matrix bed. The fuel/air mixture is combusted within the porous matrix bed and a combustion flame is stabilized completely within the porous matrix bed. The porous matrix bed is constructed as a bed of refractory particles.

11 Claims, 5 Drawing Sheets

ULTRA-LOW POLLUTANT EMISSIONS RADIANT GAS BURNER WITH STABILIZED POROUS-PHASE COMBUSTION

BACKGROUND OF THE INVENTION

1. Field of the Invention

This invention relates to a process and apparatus for a radiant gas burner in which a combustion flame is stabilized completely within a porous matrix bed of the radiant gas burner.

2. Description of Prior Art

Conventional gas-fired infrared burners use flame energy or hot gases to heat a radiating refractory or other suitable heat transfer material and thus produce a relatively flat flame on and/or above a radiating surface of the burner. Radiant tube burners have internally fired radiation units in which a radiating surface is interposed between a flame and a load. Surface combustion infrared burners have a radiating surface with a porous refractory through which a combustion mixture is passed and then burned above the surface to heat the surface by conductive heat transfer. Gas-fired infrared generators have a burner with a radiating refractory surface which is heated directly with a gas flame. Also, other infrared generators use a porous catalyst bed to oxidize fuel at a relatively low temperature in a low-temperature catalytic burner.

U.S. Pat. No. 4,643,667 discloses a non-catalytic porous-phase combustor and process for generating radiant heat energy. A gas phase reaction and combustion occur within pores of a multi-layer porous plate. The combustible fuel mixture is introduced through an inlet and then distributed within a distribution chamber. The combustible fuel mixture then enters a porous low-thermal conductivity layer which is heated through conduction heat transfer from combustion within a high-thermal conductivity layer. According to the '667 patent, a thermal gradient is established within the low-thermal conductivity layer, with the lowest temperature at the interface of the low-thermal conductivity layer. The highest temperatures occur at an interface between the low-thermal conductivity layer and a contiguous high-thermal conductivity layer.

U.S. Pat. Nos. 4,666,400, 4,605,369 and 4,354,823 disclose various radiant burners in which combustion occurs at a face or outside surface of a gas permeable matrix. Such surface combustion produces results which significantly differ from combustion stabilized within a porous matrix bed.

U.S. Pat. No. 4,416,618 teaches a gas-fired infrared generator with porous ceramic fiber panels. A combustion mixture flows through the fiber panels and is combusted on the surface of the panels. U.S. Pat. No. 3,188,366 discloses a heating process in which a mixture of combustible gases passes through porous refractory material and is combusted at or above the surface, forming a continuous mantle of flameless high-temperature flue gases.

U.S. Pat. Nos. 4,673,349, 3,833,338 and 4,597,734 each disclose a surface combustor. According to the '349 patent, combustion occurs at the surface of a burner plate. According to the '338 patent, an air-gas mixture is combusted at the surface of a cloth or blanket. The '734 patent teaches combustion occurring at a surface of a porous element. None of such patents either teach or suggest stabilizing combustion within a porous matrix bed.

U.S. Pat. Nos. 4,529,123 and 4,673,350 each disclose radiant heating systems which do not include a porous matrix distributor for the combustible gases. U.S. Pat. Nos. 4,608,012 and 4,610,623 each disclose gas burners. The '012 patent discloses a plaque of ceramic foam material and combustion occurs at the surface of such ceramic foam material.

U.S. Pat. No. 4,604,051 discloses a regenerative burner. U.S. Pat. No. 4,599,066 teaches a radiant energy burner in which a combustible fuel mixture is ignited on the outer surface of a fabric. U.S. Pat. No. 3,322,179 discloses a fuel burner with a porous matrix and combustion occurs at the surface of the porous matrix.

U.S. Pat. No. 4,529,374 discloses a gas particulate solid system wherein fuel is supplied to a crater portion of bed material. U.S. Pat. No. 4,878,837 teaches an infrared burner which operates with extremely low overall pressure drop.

As noted from the prior art described above, conventional radiant gas burners operate with combustion and a combustion flame at or above either a radiant surface or a top surface of the porous bed. Other than the '667 patent which suggests flame stabilization in a porous matrix bed which has at least two discrete and contiguous layers, none of the prior art references discussed above either teach or suggest stabilizing a combustion flame within a porous matrix bed to achieve better overall efficiency of the radiant gas burner. None of such prior art references either teach or suggest flame stabilization within a porous matrix bed having only one layer of refractory particles.

SUMMARY OF THE INVENTION

It is one object of this invention to provide a radiant gas burner in which a fuel/air mixture is introduced into an inlet of the burner and flows downstream through diverging cross-sectional areas of a porous matrix bed, along a generally longitudinal axis of the burner.

It is another object of this invention to provide a radiant gas burner wherein a combustion flame is stabilized completely within the porous matrix bed.

It is yet another object of this invention to reduce combustion emissions, such as nitrogen oxides, by enhancing heat removal from the combustion zone and reducing the reaction time.

It is still another object of this invention to provide a radiant gas burner in which a surface temperature of a radiant surface layer which is adjacent and downstream from the porous matrix bed is greater than a gas temperature of the combustion products, or flue gas, leaving the radiant surface layer.

The above objects of this invention are accomplished with a radiant gas burner having a fuel/air inlet and a flow distributor position near a downstream end of the fuel/air inlet. In one preferred embodiment according to this invention, a flow distributor is positioned at an upstream end of the porous matrix bed. It is an important aspect of this invention for the porous matrix bed to have a diverging cross-sectional area, in a downstream direction, along a longitudinal axis of the porous matrix bed and the overall burner. Such diverging cross-sectional area of the porous matrix bed is one important aspect of this invention which allows flame stabilization completely within the porous matrix bed. Such flame stabilization within the porous matrix bed results in a surface temperature at a downstream end of the porous matrix bed which is greater than the gas temperature of the combustion products, or flue gas, leaving such surface.

In one preferred embodiment according to this invention, the cross-sectional area diverges in a linear fashion from an upstream end to a downstream end of the porous matrix bed. In another preferred embodiment according to this invention, the cross-sectional area diverges in a curved fashion. In yet another preferred embodiment according to this invention, the porous matrix bed is in a form of a tube or hollow cylinder and the cross-sectional area diverges along an increasing radius of the porous matrix bed.

A flow distributor is preferably positioned adjacent or near an upstream end of the porous matrix bed. The flow distributor is used to evenly distribute the fuel/air mixture throughout the porous matrix bed. In one preferred embodiment according to this invention, the porous matrix bed comprises a plurality of refractory particles. The flow distributor can be used to support the refractory particles.

A radiant surface layer is preferably positioned adjacent and downstream from the downstream end of the porous matrix bed. The radiant surface layer can either be an integral portion of the porous matrix bed or may comprise a rigid porous plate secured adjacent or near the downstream end of the porous matrix bed. The radiant surface layer is preferably coated with a relatively high-emissivity material, for increased radiation heat transfer.

A process for stabilizing a combustion flame within a radiant gas burner, as described above, begins with introducing fuel and air into an inlet of the radiant gas burner. The fuel and air is then distributed, preferably evenly, through the porous matrix bed. The fuel/air mixture flows through the porous matrix bed along a cross-sectional area which diverges along the generally longitudinal axis, in a direction from the upstream end to the downstream end, of the porous matrix bed. The fuel/air mixture is controlled and combusted within the porous matrix bed so that a combustion flame is completely stabilized within the porous matrix bed. Combustion products are then exhausted through the downstream end of the porous matrix bed.

In another preferred embodiment according to this invention, the combustion products are exhausted through a radiant surface layer which is positioned adjacent and downstream from the downstream end of the porous matrix bed. The radiant surface layer preferably operates at a temperature between approximately 2200° F. to approximately 2700° F., for maximizing radiation heat transfer from the burner.

In a process according to one preferred embodiment of this invention, the fuel and the air are preferably combusted at a stoichiometric ratio of approximately 1.2 to approximately 2.5. Also according to the process of this invention, a turndown ratio is greater than approximately 6:1.

The diverging cross-sectional area of the porous matrix bed in combination with preferred design flow parameters of the fuel/air mixture, operating temperature and pressure, and other fluid characteristics are varied to achieve flame stabilization completely within the porous matrix bed. Such flame stabilization within the porous matrix bed significantly increases the overall efficiency of the radiant gas burner.

BRIEF DESCRIPTION OF THE DRAWINGS

Further features of this invention will be apparent from the following detailed description of the invention read in conjunction with the drawings, wherein.

DESCRIPTION OF PREFERRED EMBODIMENTS

Porous-phase combustion produces relatively high radiant heat conversion, relatively high combustion intensity, and relatively low combustion emissions. With complete combustion within a porous media, a downstream burner radiant surface receives convectional heat transfer from the combustion products flowing through the porous media. The heated radiant surface then radiates heat to a load with relatively high intensity because of the relatively high surface temperature and high radiation emissivity of the radiant surface. Combustion intensity within a porous media is high, relative to open combustion, since the combustion reaction is completed within a relatively small volume. Combustion products, such as nitrogen oxides, are significantly reduced when combustion occurs within the porous media, due to the relatively high removal of heat from the combustion reaction and the relatively short residence time in the reaction zone. Thus, it is apparent that there are many advantages to operating a radiant gas burner with combustion and flame stabilization completely within the porous media or porous matrix bed.

Figure 1:
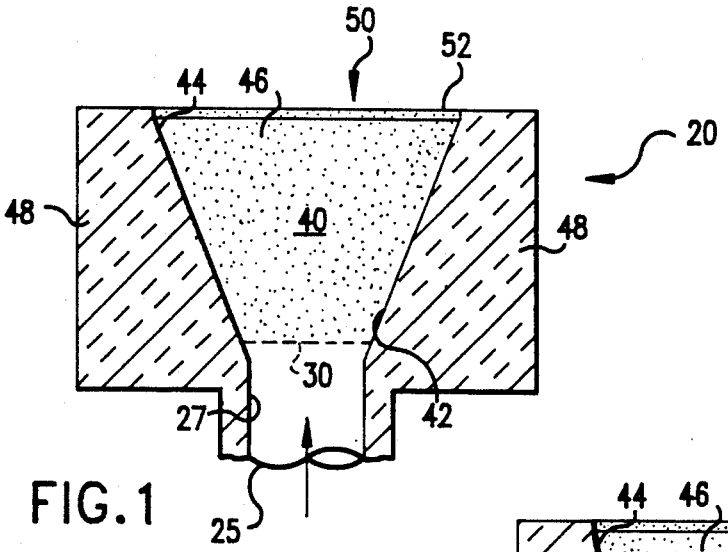
FIG. 1 is a cross-sectional view of a radiant porous burner having a cross-sectional area diverging at a constant rate, according to one embodiment of this invention.
Figure 2:
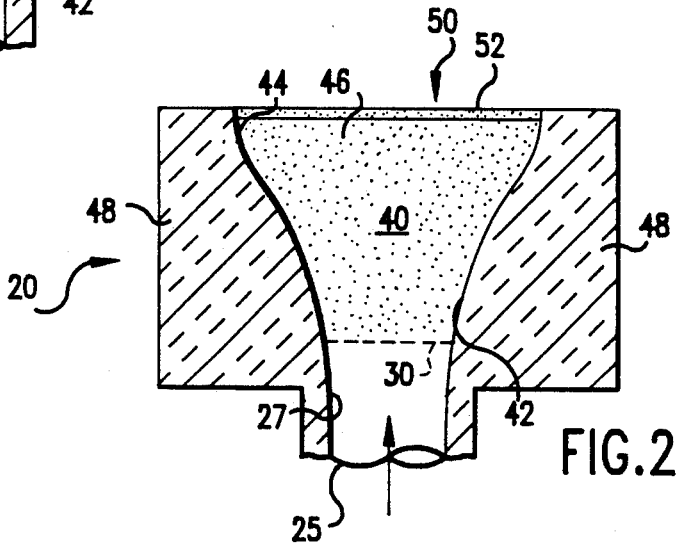
FIG. 2 is a cross-sectional view of a radiant gas burner having a cross-sectional area diverging at a variable rate, according to another embodiment of this invention.
Figure 3:
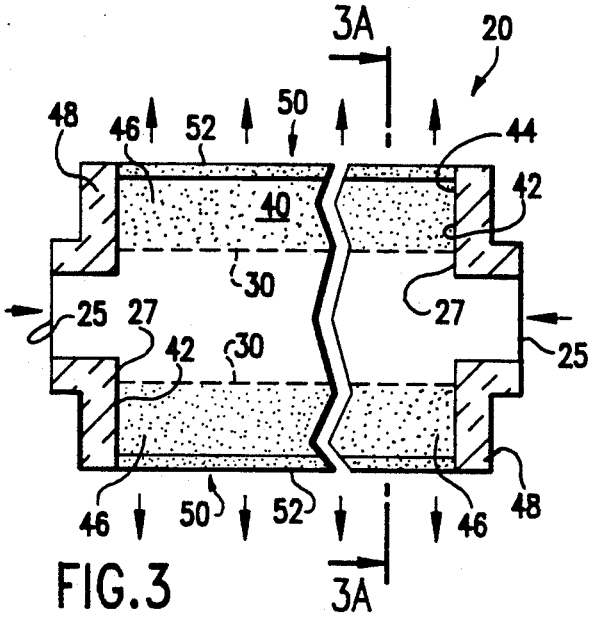
FIG. 3 is a cross-sectional view of a radiant porous burner wherein the porous matrix bed is in the shape of a tube, according to another embodiment of this invention.

A radiant gas burner according to this invention achieves such advantages by establishing self-stabilized combustion within the porous media. The diverging cross-sectional area design of the porous matrix bed is a very important aspect of this invention and a contributing factor to stabilizing combustion within the porous matrix bed. FIGS. 1-3 illustrate three different preferred embodiments of such diverging cross-sectional area, according to this invention.

Porous matrix bed 40 of this invention comprises one discrete layer of refractory particles 46. Using only one layer of refractory particles 46 within porous matrix bed 40 minimizes heat transfer toward upstream end 42 of porous matrix bed 40 and thus prevents flashback. Operating parameters of the gas burner can also be used to control and maintain combustion within the porous matrix bed. For example, the combustion intensity and the stoichiometric ratio of the fuel/air mixture can be varied to control the combustion.

Within the diverging porous matrix bed 40, as the reaction zone moves upstream within porous matrix bed 40, the local flow velocity and corresponding convectional heat transfer is increased due to the reduction of the cross-sectional area of the porous bed, and the reaction rate is decreased due to an increase in convectional heat transfer. Thus, flashback is self-prevented by confining the reaction zone completely within porous matrix bed 40. Another advantage of maintaining combustion within porous matrix bed 40 is the elimination of an outer flame or a flame which extends beyond radiant surface layer 40 of the combustion burner, in a reverse process. Therefore, combustion can be self-stabilized within the diverging porous matrix bed.

It is possible to ignite the fuel/air mixture within porous matrix bed 40 and then stabilize combustion within a preferred range of operating parameters. The firing rate and the stoichiometric ratio of the fuel/air mixture can be adjusted within a relatively wide range, based on either the temperature in porous matrix bed 40 and/or the pressure drop across porous matrix bed 40. According to this invention, it is also possible to ignite the fuel/air mixture above radiant surface layer 5 to initiate a blue flame. If ignited above radiant surface layer 50, the flame will regress in the porous bed by reducing the combustion air.

FIGS. 1 and 2 show two different embodiments of radiant gas burner 20, according to this invention. Radiant gas burner 20 comprises fuel/air inlet 25 which is used to admit a fuel/air mixture into porous matrix bed 40. It is apparent that fuel/air inlet 25 may comprise one inlet passage or nozzle as shown in FIGS. 1 and 2, a combination of individual fuel/air inlet nozzles, or any other suitable fuel/air inlet means familiar in the art. The fuel and air are preferably introduced as a combustible mixture; however, it is also apparent that the fuel and air can be introduced individually or separately into fuel/air inlet 25 and then combined upstream of or at flow distributor 30, which is mounted at upstream end 42 of porous matrix bed 40.

Since porous matrix bed 40 preferably comprises a bed of refractory particles 46, upstream end 42 of porous matrix bed 40 is preferably adjacent a downstream end of flow distributor 30. As shown in FIGS. 1 and 2, flow distributor 30 also serves as a support for porous matrix bed 40.

Refractory particles 46 preferably comprise material such as alumina, silicon carbide, zirconia or any other suitable refractory material. Such refractory materials are relatively inexpensive compared to other foam or ceramic fiber materials used in conventional radiant burners. Refractory particles 46 are preferably sized between approximately 1/16 inch and approximately ¼ inch. Referring to the size of refractory particles as a one-dimensional value is commonly known within the art of refractory particles. Refractory particles 46 also have a long useful life, relative to other foam or ceramic fiber materials. Refractory particles 46 are used to increase the overall efficiency of the burner by allowing complete combustion within a relatively small volume of the porous media. Refractory particles 46 also facilitate flame stabilization completely within porous matrix bed 40. The individual refractory particles 46 also create a relatively low pressure drop across porous matrix bed 40, as compared to other foam or ceramic fiber materials. With refractory particles 46, porous matrix bed 40 is not as susceptible to clogging from dust carried into the bed by combustion air and/or fuel. Also, refractory particles 46 provide better overall performance of thermal shock, particularly during the drastic temperature differential during startup and shutdown of radiant gas burner 20.

Figure 3A:
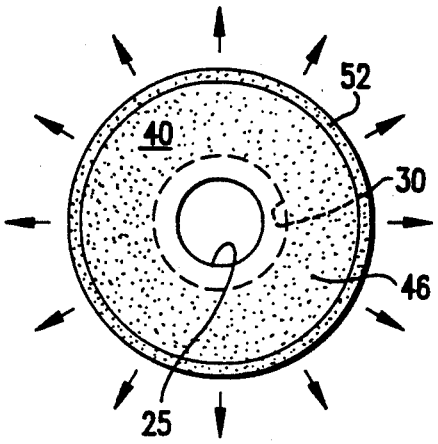
FIG. 3A is a sectional view taken along line 3A—3A, as shown in FIG. 3.

FIG. 1 shows porous matrix bed 40 diverging at a constant rate in a linear fashion whereas FIG. 2 shows porous matrix bed 40 diverging at a variable rate in a curved fashion. FIG. 3 shows yet another preferred embodiment of radiant gas burner 20 wherein porous matrix bed 40 diverges in a radial direction, along an increasing radius of porous matrix bed 40. As shown in FIGS. 3 and 3A, porous matrix bed 40 has a tubular shape. The fuel/air mixture is introduced into fuel/air inlet 25 and proceeds downstream to flow distributor 30 and then through refractory particles 46 of porous matrix bed 40. Finally, combustion products are discharged through radiant surface layer 50, which is shown in the drawings as rigid porous plate 52. Radiant surface layer 50 is a preferred but not necessary element of the embodiments shown in FIGS. 1 and 2. However, radiant surface layer 50, shown as rigid porous plate 52 in FIGS. 3 and 3A, is a necessary element of such embodiment, since without radiant surface layer 50, refractory particles 46 would not maintain their tubular shape. Refractory particles 46 are supported between flow distributor 30 and rigid porous plate 52. It is apparent that rigid porous plate 52 can have a surface perforated with holes or slots, or any other gas permeable surface which allows combustion products to pass through radiant surface layer 50. In on preferred embodiment according to this invention, radiant surface layer 50 is coated with a relatively high-emissivity material, preferably having an emissivity factor greater than 0.80, for increased radiation heat transfer. As shown in FIGS. 1 and 2, rigid porous plate 52 preferably abuts or is adjacent downstream end 44 of porous matrix bed 40 and thus no gap exists between such elements.

Figure 4:
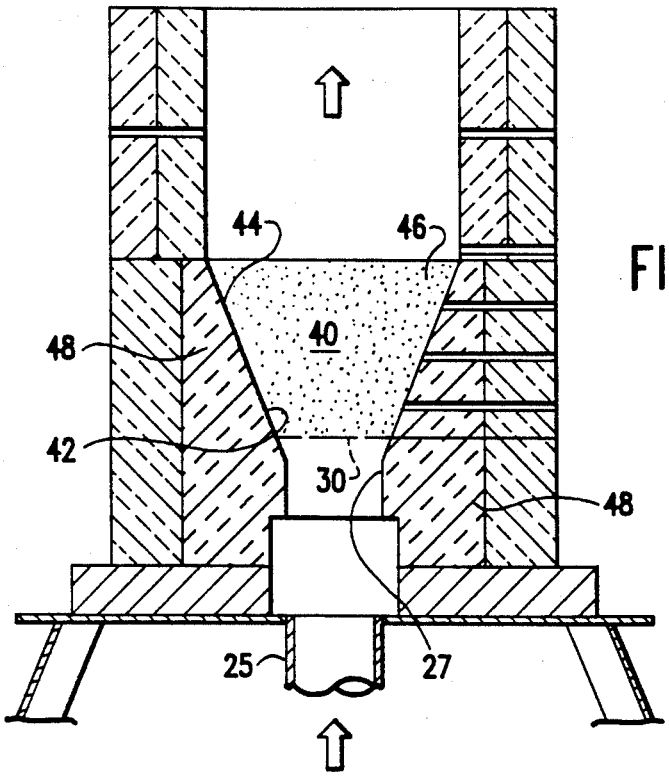
FIG. 4 is a cross-sectional schematic view of a complete apparatus for a radiant porous burner, according to one embodiment of this invention.

FIG. 4 shows a cross-sectional schematic diagram of a complete apparatus which was used for testing radiant gas burner 20, according to this invention. As shown, test probes are located at various positions within porous matrix bed 40 and a flue stack.

A process for stabilizing a combustion flame within porous matrix bed 40 of radiant ga burner 20 begins with introducing the fuel/air mixture into fuel/air inlet 25. Again, a fuel/air mixture is preferred but it is apparent that the fuel and air can be introduced separately and mixed upstream of flow distributor 30. The fuel/air mixture flows through flow distributor 3 and is thus distributed, preferably evenly, throughout porous matrix bed 40. The fuel/air mixture flows through the cross-sectional area which diverges along a generally longitudinal axis in a direction from upstream end 42 to downstream end 44 of porous matrix bed 40. The fuel-/air mixture is then combusted and because of the diverging cross-sectional area of porous matrix bed 40, a combustion flame is stabilized completely within porous matrix bed 40. The combustion products are then exhausted through downstream end 44. The combustion products finally flow through radiant surface layer 50 which is positioned adjacent and downstream from downstream end 44 of porous matrix bed 40.

The fuel/air mixture preferably has a stoichiometric ratio of approximately 1.2 to approximately 2.5. Also, the fluid flow parameters are controlled so that a turndown ratio is greater than approximately 6:1. When operating, radiant surface layer 50 is preferably maintained at a temperature from approximately 2200° F. to approximately 2700° F.

Figure 5:
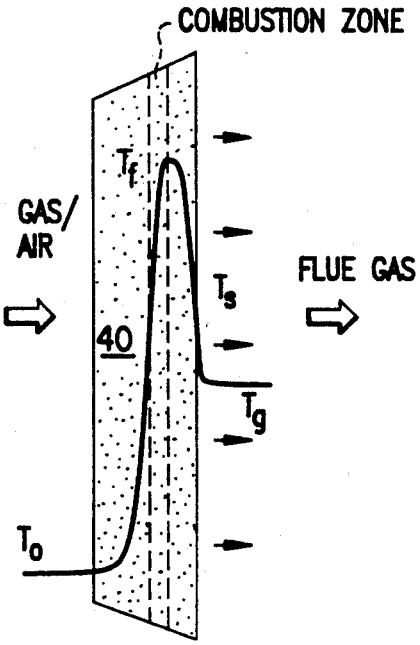
FIG. 5 is a schematic diagram showing a temperature curve throughout a radiant porous burner according to this invention wherein complete combustion occurs within the porous matrix bed.
Figure 5A:
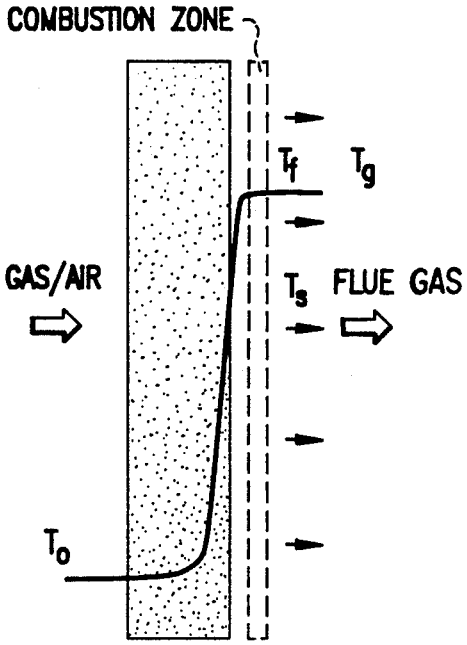
FIG. 5A is a schematic diagram showing a temperature curve, for comparison purposes, throughout a conventional radiant burner wherein combustion occurs downstream from the gas permeable bed.

FIGS. 5 and 5A show a graphical representation of a temperature profile across different gas permeable beds. FIG. 5 shows a temperature profile of porous matrix bed 40, according to this invention. The combustion zone is shown in dashed lines and is maintained within porous matrix bed 40. The highest temperature $T_f$ occurs within the combustion zone. As the combustion products flow through porous matrix bed 40 according to this invention, heat transfer occurs from the combustion product gases to porous matrix bed 40 and the temperature drops to surface temperature $T_s$ at the surface of either porous matrix bed 40 o radiant surface layer 50. As the combustion products gases flow further downstream, the temperature of the gas surrounding either porous matrix bed 40 or radiant surface layer 50 drops to gas temperature $T_g$. It is important to note that with radiant gas burner 20 according to this invention, as represented in FIG. 5, the gas temperature $T_g$ is less than the surface temperature $T_s$ because of significant radiation heat transfer from radiant surface layer 50 to the surrounding load.

FIG. 5A represents a temperature profile of a conventional radiant burner. As shown in dashed lines, the combustion zone is within the gas surrounding a downstream end of either the porous matrix bed or the radiant surface layer. The highest temperature $T_f$ occurs within the combustion zone. The gas temperature $T_g$ of the combustion products is equal to the flame temperature $T_f$. Conduction and radiation heat is transferred from the combustion gas to the upstream surface of radiant surface layer 50. The upstream surface of radiant surface layer 50 is heated to a surface temperature $T_s$ which is much lower than the flame temperature $T_f$ because the direction of gas flow is contrary to the direction of the heat transfer. Contrary to the conventional radiant burner, according to radiant gas burner 20 of this invention, as illustrated in FIG. 5, the temperature decreases from $T_f$ within the combustion zone to the downstream side of radiant surface layer 50, resulting in a higher surface temperature $T_s$, because the direction of gas flow is the same as the direction of the heat transfer It is important to note that according to the conventional radiant burner, as represented in FIG. 5A, the surface temperature $T_s$ is less than the surrounding gas temperature $T_g$ due to combustion downstream of the bed.

Figure 6:
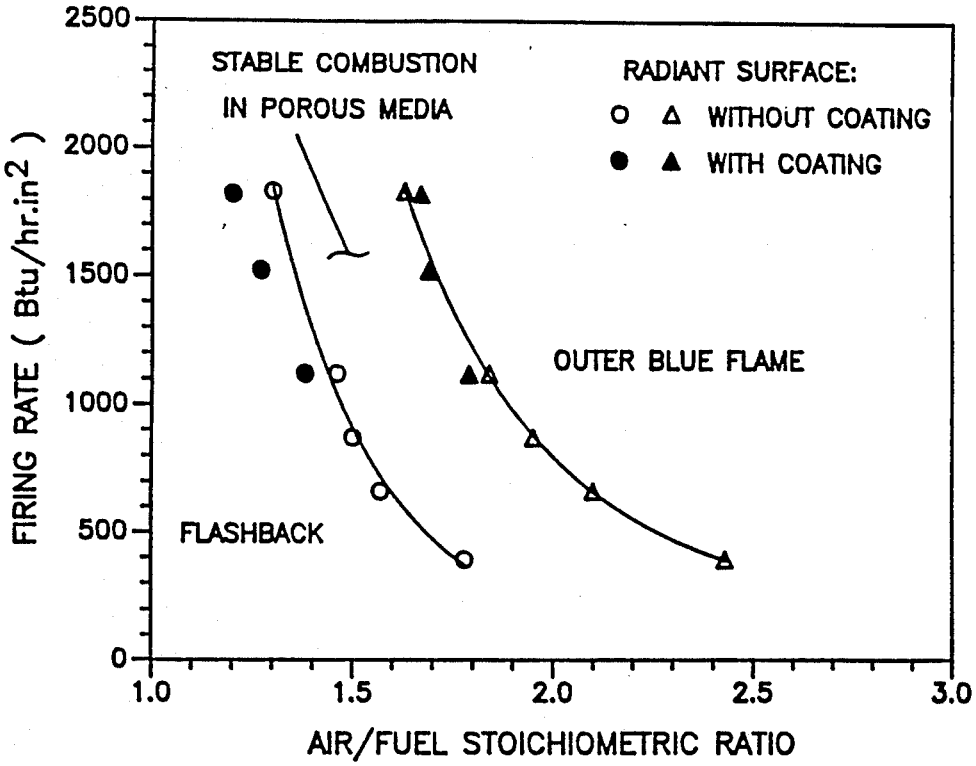
FIG. 6 is a graphical representation of operational ranges of a radiant porous burner, according to this invention.

FIG. 6 shows a graphical representation of the operating regime at various flow conditions from radiant gas burner 20 according to this invention. As shown from the test results of FIG. 6, radiant gas burner 20 can operate at relatively high turndown ratios, particularly turndown ratios greater than 6:1. As shown by the area between the curves, the test results prove that flame stabilization occurs completely within porous matrix bed 40. As shown, the preferred fuel/air stoichiometric ratio is in a range from approximately 1.2 to approximately 2.5.

Figure 7:
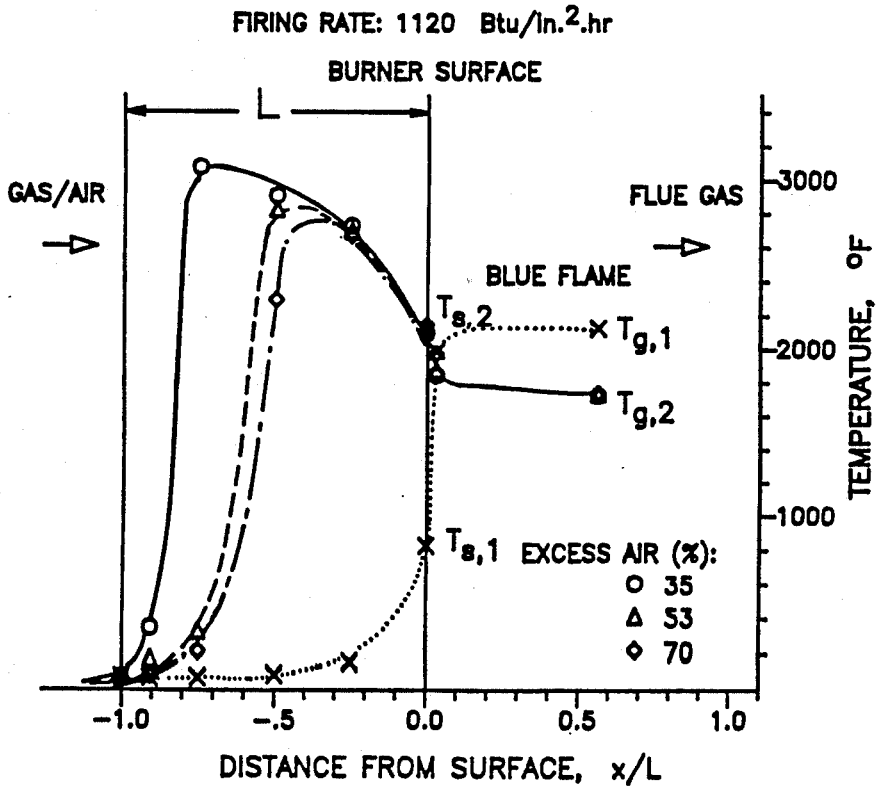
FIG. 7 is a graphical representation showing the difference in temperature profiles between combustion completely within a porous matrix bed of a radiant porous burner according to this invention and combustion downstream from a radiant surface of a conventional radiant burner, at different levels of excess air.

FIG. 7 is a graphical representation of various temperature profiles in radiant gas burner 20 according to this invention, at different excess air levels. The solid line, dashed line and phantom line curves represent combustion occurring completely within porous matrix bed 40 of radiant gas burner 20, according to various embodiments of this invention. The dotted line curve represents combustion occurring above either the gas permeable bed material or radiant surface layer, as in conventional radiant burners. Again, it is noted that according to this invention, the surface temperature, represented by $T_{s,2}$, is greater than the flue or exhaust gas temperature, which is represented by $T_{g,2}$. According to conventional radiant burners wherein the flame is maintained above the radiant surface layer, as represented by the dotted line curve, it is noted that the surface temperature, represented by $T_{s,1}$, is less than the flue or exhaust gas temperature, which is represented by $T_{g,1}$. Also noted, $T_{s,2}$ is much higher than $T_{s,1}$, resulting in much greater radiation heat transfer from radiant gas burner 20. As noted, the firing rate, during performance of the test according to the data from FIG. 7, was maintained at 1120 Btu/in$^2$-hr.

Figure 8:
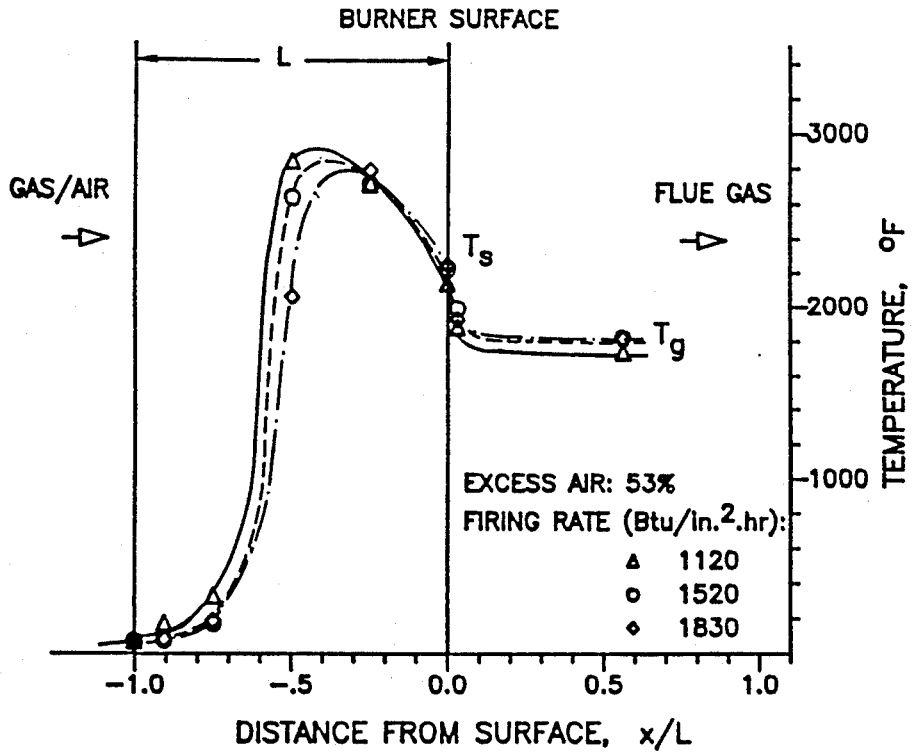
FIG. 8 is a graphical representation of temperature profiles, at different firing rates, in a radiant porous burner according to this invention.

FIG. 8 is a graphical representation of various temperature profiles in radiant gas burner 20 according to this invention, at different firing rates and constant 53% excess air. The solid line represents the temperature profile at a firing rate of 1120 Btu/in$^2$-hr, the dashed line at 1520 Btu/in$^2$-hr, and the phantom line at 1830 Btu-/in$^2$-hr.

Figure 9:
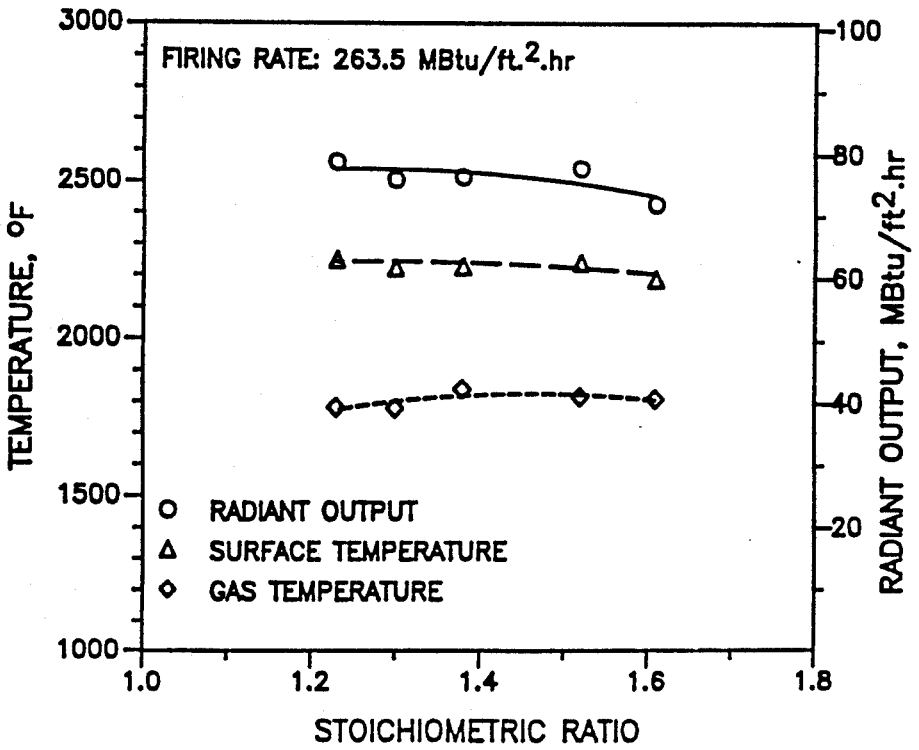
FIG. 9 is a graphical representation of temperature and radiant heat output as both values vary with a stoichiometric ratio, as well as excess air, according to this invention.

FIG. 9 is a graphical representation of the effect of excess air on the radiant output. Such data shows that the radiant output of radiant gas burner according to this invention is approximately 80 MBtu/ft$^2$-hr, when the firing rate is maintained at 263.5 MBtu/ft$^2$-hr. Such graph of FIG. 8 also shows a surface temperature of approximately 2200° F. However, it is apparent that in certain embodiments with other flow conditions, the surface temperature can reach approximately 2700° F.

Figure 10:
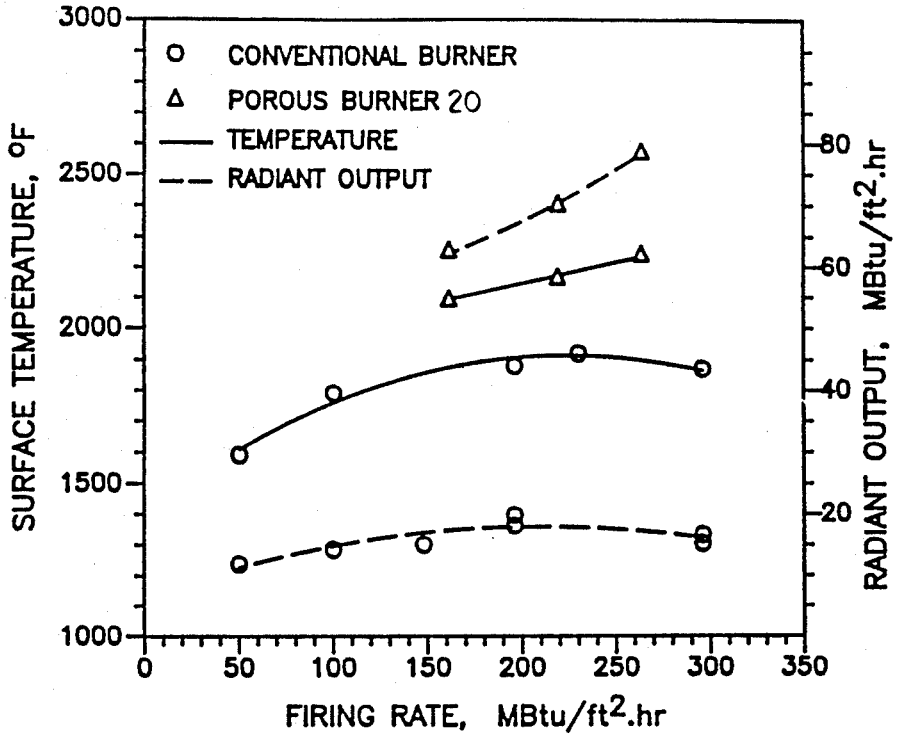
FIG. 10 is a graphical representation of a comparison of surface temperature and radiant heat output at various firing rates, between a porous gas burner according to this invention and a conventional radiant burner.

FIG. 10 is a graphical representation of test results from radiant gas burner 20 according to this invention, as shown by the triangular reference points. Such graph also shows test results from a conventional radiant burner, as represented by the circular points on the graph. Such test results show that the radiant output of radiant gas burner 20 according to this invention is approximately 4 times more than the conventional radiant burner. For example, at a firing rate of approximately 270 MBtu/ft$^2$-hr, test results indicate that a radiant gas burner 20 according to this invention has a radiant output of approximately 80 MBtu/ft$^2$-hr whereas test results indicate that the conventional radiant burner has a radiant output of approximately 20 MBtu/ft$^2$-hr.

Figure 11:
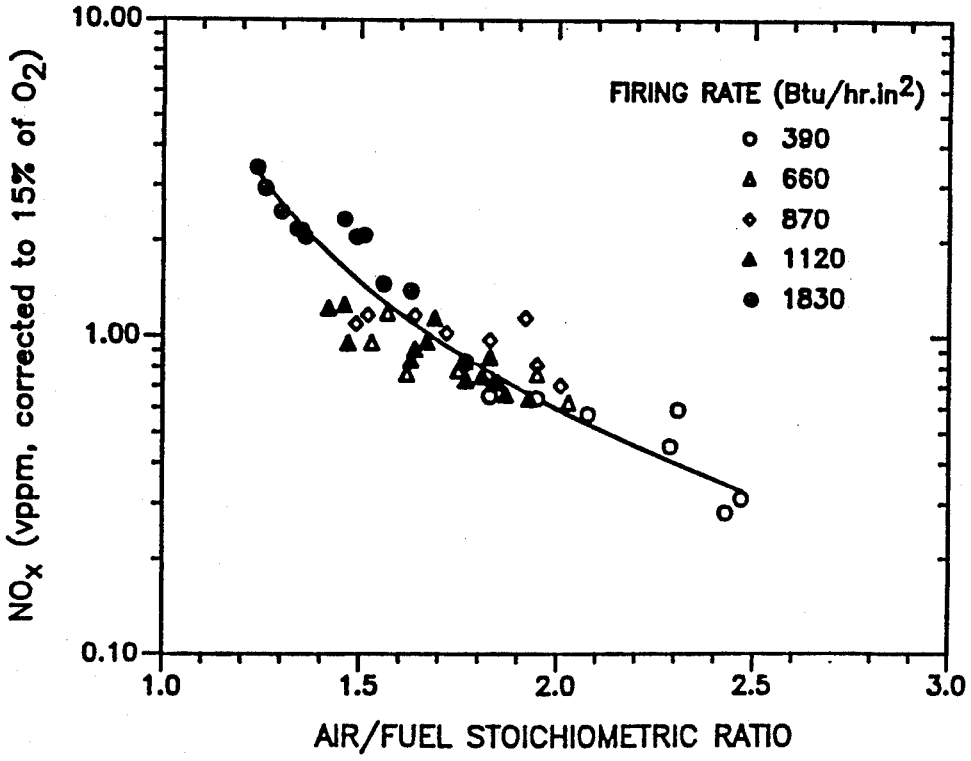
FIG. 11 is a graphical representation of nitrogen oxides emissions measured from the test burner versus the fuel/air stoichiometric ratio at various firing rates, according to this invention.

FIG. 11 is a graphical representation of nitrogen oxides emissions at various firing rates and air/fuel stoichiometric ratios. Again, it is noted that the preferred air/fuel stoichiometric ratio range is between approximately 1.2 and approximately 2.5. The nitrogen oxides emissions range from approximately 0.3 to approximately 3 vppm, corrected to 15% of oxygen.

Radiant gas burner 20 according to this invention, which stabilizes a combustion flame within porous matrix bed 40, results in an efficient radiant burner. Radiant gas burner 20 according to this invention has relatively high combustion intensity, relatively high radiation intensity, and ultra-low nitrogen oxides emissions when compared with conventional radiant burners. Furthermore and according to this invention, radiant gas burner 20 operates with a relatively high turndown ratio and a relatively low pressure drop across porous matrix bed 40. Because porous matrix bed 40 comprises refractory particles 46, the bed is not susceptible to clogging.

It is apparent that radiant gas burner 20, according to this invention, can be positioned upstream of conventional heat exchange tubes or another suitable heat exchanger device. In such application, the relatively hot flue gases as well as radiant surface layer 50 transfer heat to the heat exchange tubes.

While in the foregoing specification this invention has been described in relation to certain preferred embodiments thereof, and many details have been set forth for purpose of illustration it will be apparent to those skilled in the art that the invention is susceptible to additional embodiments and that certain of the details described herein can be varied considerably without departing from the basic principles of the invention.

I claim:

1. A radiant gas burner comprising: a fuel/air mixture inlet, a flow distributor positioned near an inlet downstream end of said fuel/air mixture inlet, a porous matrix bed comprising one of a plurality of discrete particles and a plurality of fibers, said porous matrix bed having an upstream matrix end, a downstream matrix end and a cross-sectional area, said upstream matrix end positioned downstream from said flow distributor, and flame stabilization means for stabilizing a combustion flame within said porous matrix bed, and a radiant surface layer adjacent and downstream from said downstream matrix end, said radiant surface layer comprising a rigid porous plate.

2. A radiant gas burner according to claim 1 wherein said flame stabilization means further comprises said cross-sectional area of said porous matrix bed diverging along a generally longitudinal axis in a direction from said matrix upstream end to said matrix downstream end.

3. A radiant gas burner according to claim 1 wherein said cross-sectional area diverges in a linear fashion.

4. A radiant gas burner according to claim 1 wherein said cross-sectional area diverges in a curved fashion.

5. A radiant gas burner according to claim 1 wherein said porous matrix bed is in a form of a hollow cylinder and said cross-sectional area diverges along an increasing radius of said porous matrix bed.

6. A radiant gas burner according to claim 1 wherein said flow distributor is perforated.

7. A radiant gas burner according to claim 1 wherein said radiant surface layer is an integral portion of said porous matrix bed.

8. A radiant gas burner according to claim 1 wherein said radiant surface layer is coated with a relatively high-emissivity material.

9. A radiant gas burner according to claim 1 wherein said discrete particles are refractor particles.

10. A radiant gas burner according to claim 9 wherein each said refractory particle is sized between approximately 1/16 inch and ¼ inch.

11. A radiant gas burner according to claim 1 further comprising insulation surrounding said porous matrix bed.

* * * * *